United States Patent [19]

Yonekawa et al.

[11] Patent Number: 4,748,955

[45] Date of Patent: Jun. 7, 1988

[54] APPARATUS FOR CONTROLLING INTERNAL COMBUSTION ENGINE

[75] Inventors: Masao Yonekawa; Mitsunori Takao, both of Kariya, Japan

[73] Assignee: Nippondenso Co., Ltd., Kariya, Japan

[21] Appl. No.: 923,937

[22] Filed: Oct. 24, 1986

[30] Foreign Application Priority Data

Oct. 30, 1985 [JP] Japan ..... 60-243507

[51] Int. Cl.[4] ..... F02M 51/00; F02P 5/14

[52] U.S. Cl. ..... 123/479; 123/416

[58] Field of Search ..... 123/479, 416, 494, 339; 364/571, 43.12

[56] References Cited

U.S. PATENT DOCUMENTS

| | | | |
|---|---|---|---|
| 4,357,919 | 11/1982 | Hattori et al. | 123/479 |
| 4,450,815 | 5/1984 | Mauri | 123/479 |
| 4,490,804 | 12/1984 | Martinsons | 123/479 |
| 4,509,480 | 4/1985 | Kull et al. | 123/479 |
| 4,521,769 | 6/1985 | Dudek et al. | 123/479 |
| 4,635,607 | 1/1987 | Yasuoka et al. | 123/479 |
| 4,641,622 | 2/1987 | Murakami | 123/479 |

*Primary Examiner*—Raymond A. Nelli

*Attorney, Agent, or Firm*—Cushman, Darby & Cushman

[57] ABSTRACT

An internal combustion engine control apparatus which infers opening and closing of a throttle valve upon failure of throttle detecting switch. A programmed computer calculates basic fuel injection amount in accordance with detected rotational speed and air flow and discriminates failure of the throttle detecting switch when output of the throttle detecting switch does not correspond to the calculated basic fuel injection amount and the detected rotational speed. When the computer discriminates failure of the switch, the computer infers opening and closing of the throttle valve by comparing the calculated basic fuel injection amount with a reference value indicative of normal fuel injection amount closed throttle. The reference value is a function of the rotational speed and updated by the calculated basic fuel injection amount under closed throttle condition.

12 Claims, 6 Drawing Sheets

| N (rpm) | 500 | 1000 | 1500 | | | 5000 | 5500 | 6000 |
|---|---|---|---|---|---|---|---|---|
| $T_{PB}$ (mS) | 0.9 | 0.8 | 0.7 | | | 0.7 | 0.8 | 0.9 |

APPARATUS FOR CONTROLLING INTERNAL COMBUSTION ENGINE

BACKGROUND OF THE INVENTION

The present invention relates to an apparatus for controlling an internal combustion engine and, more particularly, to an apparatus for controlling the operation of an internal combustion engine when it is impossible to sense whether the throttle valve is open or closed.

Conventional apparatus for controlling the internal combustion engine of vehicle have detected the state of the engine by way of various sensors and switches installed in the engine. According to the state detected, the apparatus have provided control of fuel injection, ignition timing, idling speed of engine, and so on.

One of the switches installed in an internal combustion engine to detect the state of operation of the engine is an idle switch which, when the throttle valve is fully closed, is turned on or actuated to produce a signal indicating the full closure of the throttle valve. This signal from the idle switch is used to control the engine, especially at idle and deceleration.

For example, when the vehicle is decelerating, a misfire tends to cause emission of unburned harmful exhaust gas and a deterioration in the fuel economy. In an attempt to eliminate these problems, a method of controlling the fuel injection has been proposed in Japanese Patent Publication Laid-Open No. 74625/1978. Specifically, this method is to shut off the supply of fuel into the engine when the idle switch is actuated and the engine speed is in excess of a certain value.

On the other hand, when the vehicle is accelerated from rest condition where the throttle valve is kept closed, a transient delay in fuel supply tends to occur. This can be compensated for by a known control method. In particular, when the idle switch is turned off in response to opening of the throttle valve, fuel is injected not synchronously with the rotation of the engine, but independently of normal fuel injection synchronized to the rotation of the engine. It is also known to control the engine speed at idle in the manner described below. First, when the following conditions are satisfied: (1) the idle switch is actuated because of closure of the throttle valve; (2) the engine speed is below a certain value; and (3) the transmission is in its neutral position, the engine is regarded as idling. The engine speed at this time is feedback controlled to approach an intended value by controlling valves which control the amount of intake air or the amount of air-fuel mixture, using feedback technique.

As described above, the idle switch is used for various controls of the engine. If the output signal from the idle switch is at fault, i.e., if the switch malfunctions, making it impossible to sense the opening or closure of the throttle valve, then the idle switch is assumed to be turned off. At this time, the supply of a certain amount of fuel is assured to allow the vehicle to be driven to a repair shop or other safe place. If the idle switch is assumed to be turned on or actuated upon malfunction, i.e., if the above-described fail-safe system is not established, the idle switch is assumed to be turned on even when the throttle valve is open. Accordingly, if the engine speed exceeded a certain value, then the supply of fuel to the engine would be cut off by the mechanism described above. As a result, the engine would come to a stall. Hence, it would be impossible to drive the vehicle to a turnout or repair shop.

When the idle switch malfunctions, if the switch is assumed turned off as mentioned previously, a problem takes place. Specifically, when the throttle valve is actually fully closed, this state is not detected. Therefore, while the vehicle is driven to a repair shop, the above-described control operation which otherwise be carried out during the opening of the idle switch is not performed at all.

For example, when the fuel supply is to be controlled, even if the throttle valve is closed and the vehicle is decelerating, the fuel supply is not cut off but continues. Therefore, when the vehicle goes to a turnout or repair shop, a misfire causes emission of unburned exhaust gas. As a result, a large amount of harmful components, especially HC, is discharged into the atmosphere. In cases of vehicle having catalyst or reactor as exhaust gas cleaner, the heat load due to unburned exhaust gas increases.

Another problem arises in connection with the control over the speed of an idling engine. Specifically, the state of idle cannot be sensed and so the engine speed is not controlled by feedback technique. For example, the system forms an open-loop control system. If the suction or intake system is chocked with dust or the like, a sufficient amount of intake air or air-fuel mixture is not secured. This reduces the engine speed, creating the possibility of a stall. In the worst case, whenever the engine of the vehicle is driven to a repair shop falls into an idle, a stall takes place.

Accordingly, it is the object of the present invention to provide a control apparatus which is used for an internal combustion engine and which infers sufficiently accurately the opening or closure of a throttle valve from signals produced from other sensors installed in the engine, excluding the idle switch, that indicate the state of the engine, provided that the idle switch is at fault and that a normal signal is not produced from the idle switch, thereby enabling various controls of the engine at idle.

DETAILED DESCRIPTION OF THE PREFERRED EMBODIMENT

A preferred embodiment of the invention is described hereinafter with reference to the drawings.

Figure 1:
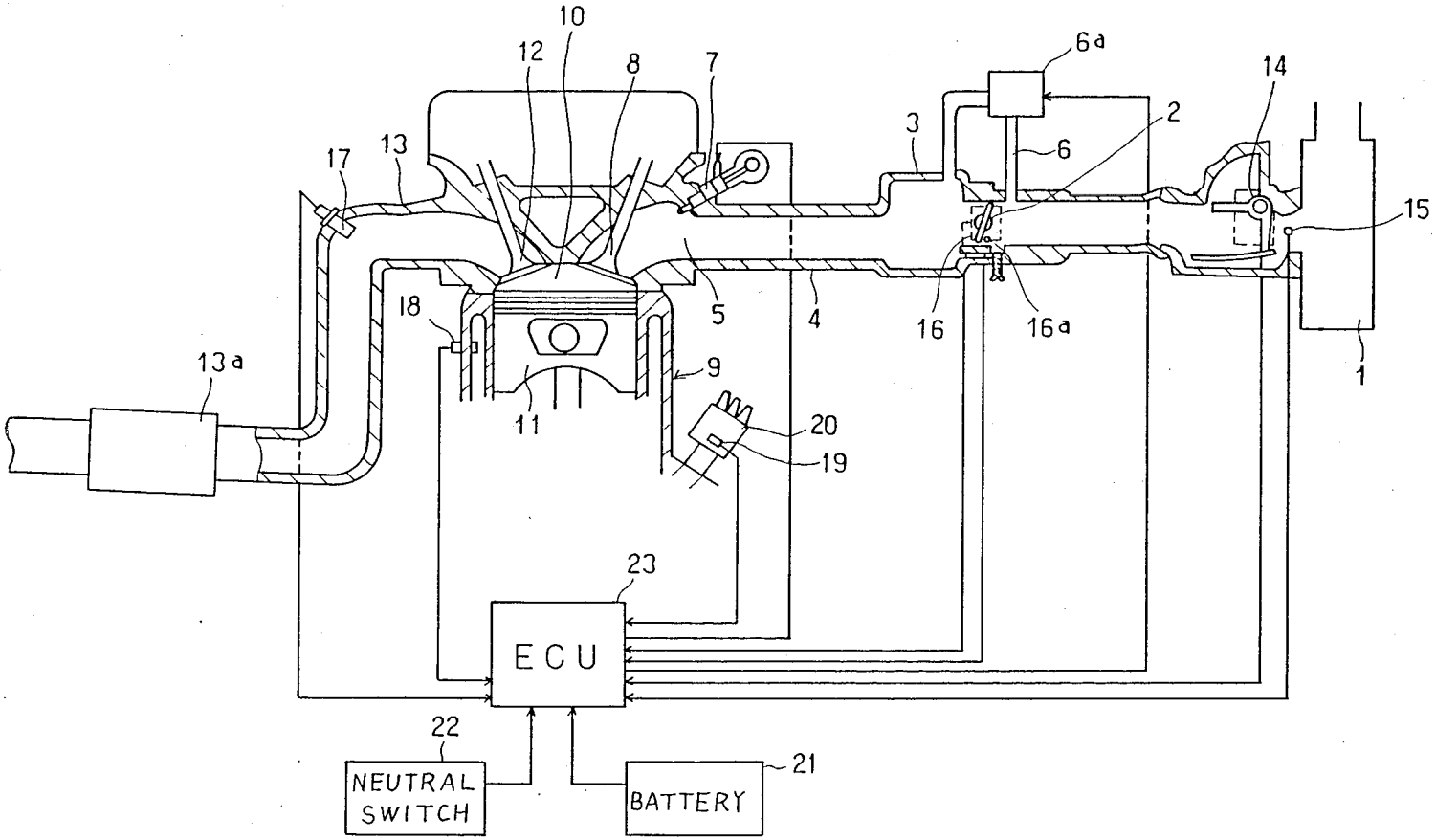
FIG. 1 is a schematic diagram of an internal combustion engine incorporating an apparatus according to the present invention.

Referring to FIG. 1, air is admitted through an air cleaner 1. The amount of the air is controlled by a throttle valve 2 interlocking with an accelerator pedal (not shown) that is operated by a driver. The air is then guided to an intake port 5 through a surge tank 3 and an intake pipe 4. The intake system is provided with a bypass passage 6 that bypasses the throttle valve 2. Mounted in this passage 6 is an airflow control valve 6a incorporating a valve body (not shown) which is electrically driven, for example by electromagnetically, to control the flow of air passing through the bypass passage 6. The valve 6a controls the quantity of air intaken or sucked at idle. A fuel injection valve 7 is mounted on the intake pipe 4, and is supplied with fuel from a fuel tank (not shown) via fuel piping (not shown). Thus, fuel is injected into the intake prot 5 from the injection valve 7. The air-fuel mixture generated at the intake port 5 is supplied into the combustion chamber 10 of an engine 9 via an air intake valve 8. The combustion chamber 10 is partitioned into sections by a piston 11. The exhaust gas produced by combustion of the mixture is discharged into the atmosphere via an exhaust valve 12, an exhaust pipe 13, and a catalytic converter 13a having rhodium.

An airflow meter 14 is mounted between the air cleaner 1 and the throttle valve 2, and delivers an analog signal which varies according to the quantity of admitted air. The meter 14 is mounted in a housing, and an intake air temperature sensor 15 is also located in this housing. The sensor 15 delivers an analog output whose level varies in response to the temperature of the intake air. A throttle sensor 16 and an idle switch 16a are disposed in association with the throttle valve 2. The sensor 16 is connected to the rotating shaft of the throttle valve 2 and delivers an analog signal whose level varies according to the degree of opening of the valve 2. The idle switch 16a senses the full closure of the valve 2. Depending on whether the valve 2 is fully closed or not, the switch 16a delivers an ON signal or OFF signal, respectively. An air-fuel ratio sensor 17 installed in the exhaust pipe 13 delivers an analog signal whose level varies according to the density of oxygen remaining in the exhaust gas. A water temperature sensor 18 installed on a water jacket of the engine 9 produces an analog signal which varies in amplitude according to the temperature of coolant water. A crankshaft position sensor 19 is disposed opposite to toothed wheel formed on the shaft of a distributor 20 coupled to the crankshaft of the engine 9. Whenever the crankshaft rotates through a given angle, the sensor 19 produces a pulse signal. Indicated by numeral 21 is a battery. A neutral switch 22 is mounted in a transmission (not shown) and turned on when the transmission is in its neutral position. That is, the switch 22 senses the neutral condition of the transmission. The sensors 14, 15, 16, 16a, 17, 18, 19, 22 and the battery 21 are connected with an electronic control unit (ECU) 23, which is energized with power from the battery 21.

Figure 2:
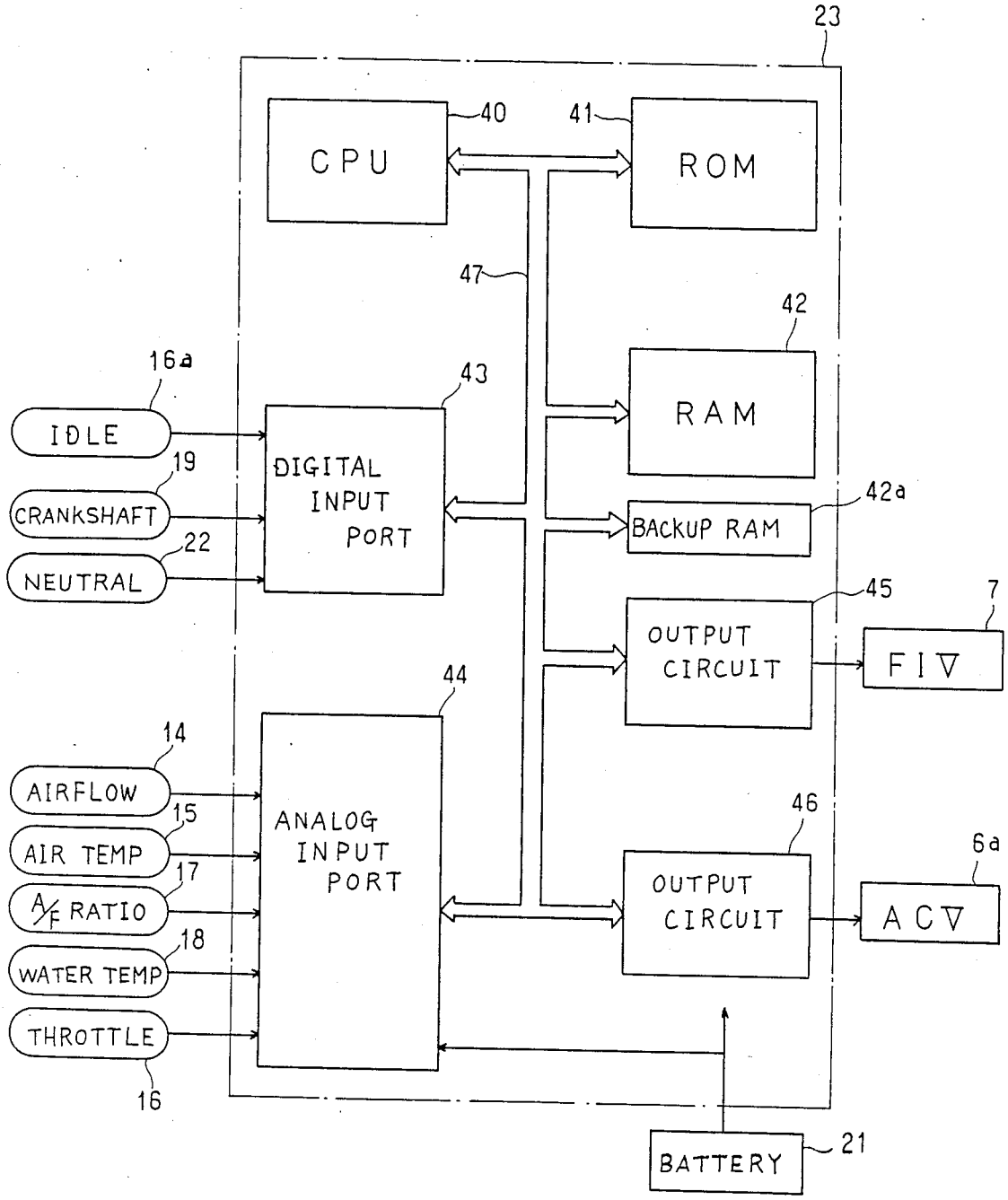
FIG. 2 is a block diagram of the electronic control unit shown in FIG. 1.

The ECU 23 is shown in FIG. 2 in the form of a block diagram. A central processing unit (CPU) 40 performs various arithmetic operations for controlling the engine, according to a stored control program. The control program and data have been previously stored in a read-only memory (ROM) 41. A random-access memory (RAM) 42 temporarily stores data, and data can be written to, or read from, the RAM 42. A backup memory 42a is similar to the RAM 42 but holds the contents even after the supply of voltage from the battery 21 is cut off. A digital input port 43 receives the pulse signal from the crankshaft position sensor 19, the ON or OFF signal from the idle switch 16a, and the ON or OFF signal from the neutral switch 22. An analog input port 44 receives the analog signals from the airflow meter 14, the intake air temperature sensor 15, the throttle sensor 16, the air-fuel ratio sensor 17, and the water temperature sensor 18, as well as the signal indicating the voltage across the battery 21. The port 44 has an analog-to-digital conversion function that converts analog input signals into digital signals. An output circuit 45 delivers a driving signal to the fuel injection valve 7. Another output circuit 46 delivers a driving signal to the airflow control valve 6a. A data bus 47 interconnects these circuits.

In the ECU 23 constructed as described above, the signals from the sensors and other components are processed by the input ports 43 and 44 and then stored in the RAM 42. The CPU 40 performs arithmetic operations at certain timings to provide various controls of the internal combustion engine, using the various kinds of data stored in the RAM 42, in accordance with the control program stored in the ROM 41. The results are stored in the RAM 42 and converted by the output circuits 45 and 46 into certain output signals in synchronism with the rotation of the engine 9 or at regular intervals. These output signals are supplied to the fuel injection valve 7 and the airflow control valve 6a.

Figure 3:
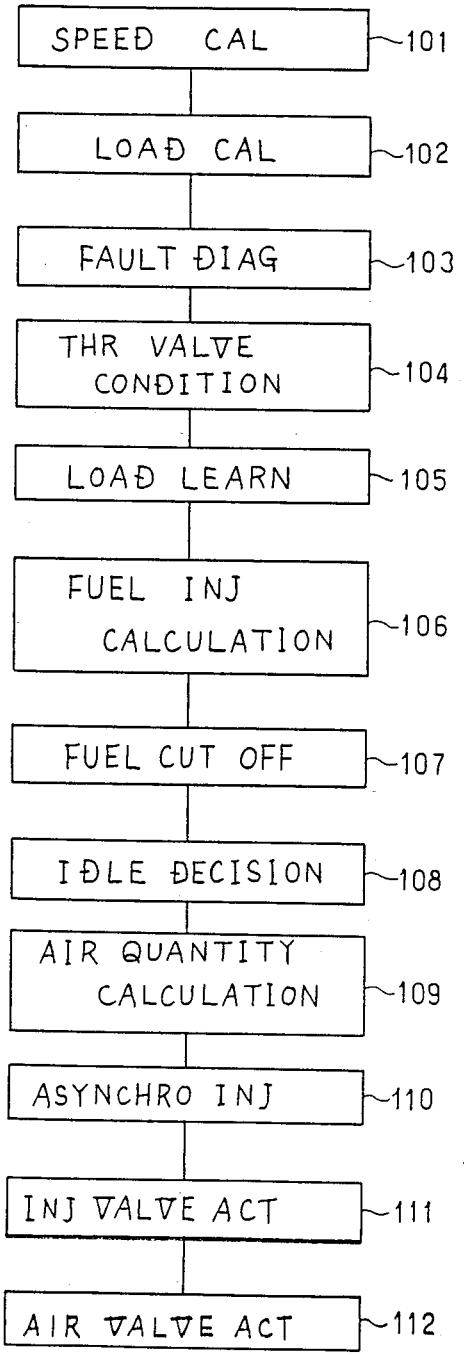
FIG. 3 is a general flow chart of control program executed by the central processing unit shown in FIG. 2.

FIG. 3 shows a portion of a control program executed by the CPU 40 to control the engine. Step 101 is a known speed calculation routine for calculating the engine speed N from the number of pulses produced by the crankshaft position sensor 19 in a certain time. The result is stored in the RAM 42. Step 102 is a load calculation routine for calculating a basic or standard injection duration $T_p(=K\times(Q/N))$ for which the fuel injection valve 7 performs injection of fuel. This duration depends on the load currently applied to the engine 9, and is calculated from the data about the amount of intake air Q stored in the RAM 42 and the data about the engine speed N stored in the RAM 42. Step 103 is a fault diagnostic routine for determing whether the output signals from the sensors are at fault or not to check the sensors for trouble.

Figure 4:
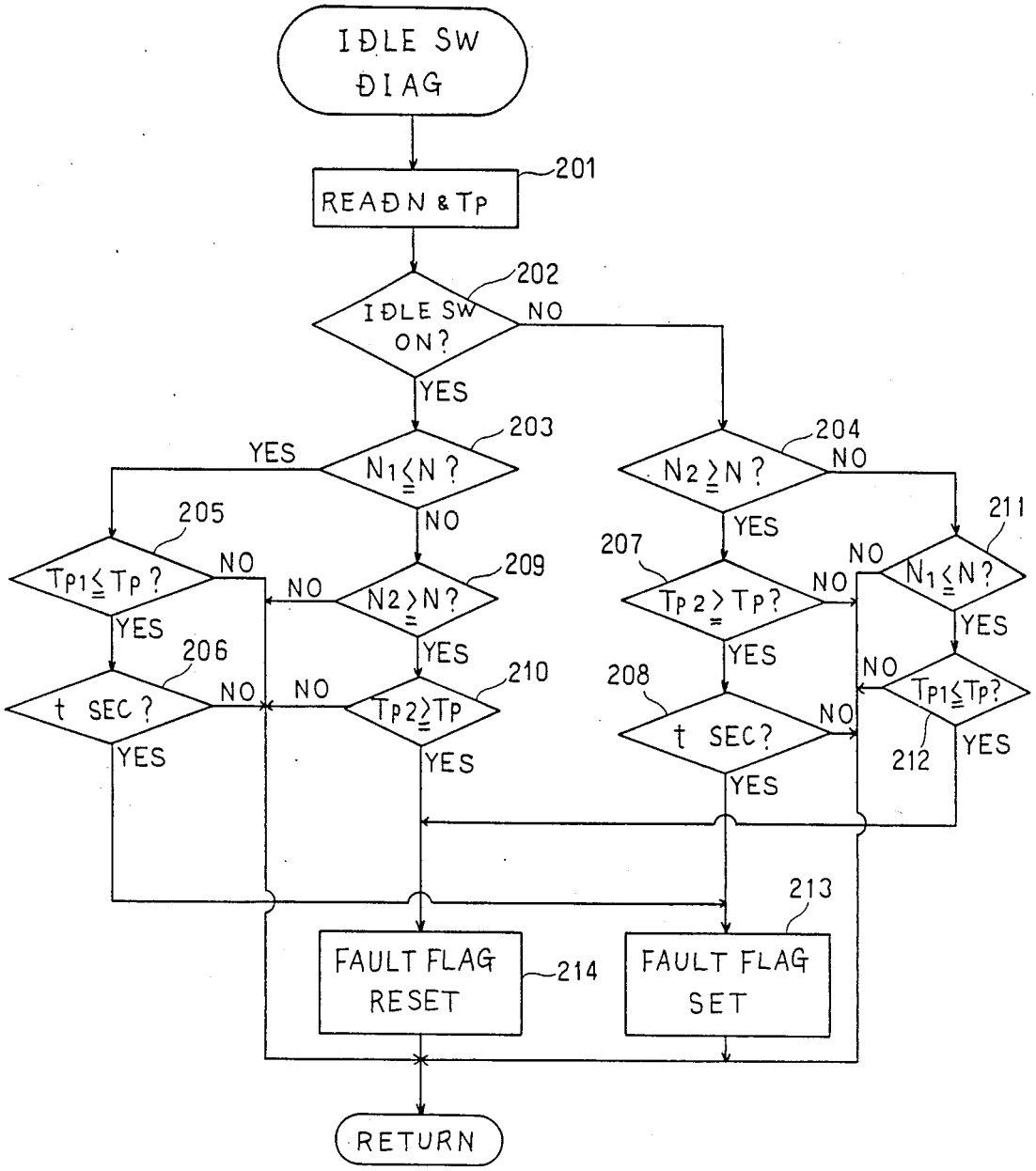
FIG. 4 is a detailed flowchart of an idle switch fault decision routine executed by the fault diagnostic routine shown in FIG. 3.

In this fault diagnostic routine, the idle switch 16a is checked for trouble in the manner as illustrated in FIG. 4. First, the data on the engine speed N and load indicated by the standard fuel injection duration $T_p$ is read from the RAM 42 ( step 201). Then, a check is made to see if the idle switch 16a is now open or closed by the use of output signal from the idle switch (step 202). If it is closed, the flow goes to step 203. If it is open, the flow proceeds to step 204. After reaching step 203, a decision is made to see if the speed N is equal to or in excess of a predetermined certain value $N_1$ which is not usual under closed throttle. If the result is YES, a decision is made to see if the standard injection period $T_p$ is equal to or in excess of a certain value $T_{p1}$ (step 205) which is not usual under closed throttle. If this high-load condition in which the speed N is high and the basic injection period $T_p$ is long continues for t seconds (step 206), the flow goes to step 213, where a flat indicating that the ON-signal from the idle switch 16a is at fault is set. When the flow proceeds to step 204, on the other hand, a decision is made to determine if the speed N is equal to or less than a predetermined certain value $N_2$ ($<<N_1$) which is not usual under open throttle. If the result is YES, a decision is made to ascertain whether the fundamental injection duration $T_p$ is equal to or less than a certain value $T_{p2}$ ($<<T_{p1}$) which is not usual under open throttle (step 207). If this state of low-load condition in which the speed N is low and the injection period $T_p$ is short persists for t seconds (step 208), a flag indicating that the OFF-signal from the idle switch 16a is at fault is also set (step 213).

If the decision made at step 203 indicates the relation $N_1>N$, a decision is made to determine if $N_2 \geqq N$ (step 209). If the relationship $N_2 \geqq N$ and $T_{p2} \geqq T_p$ holds (step 210) indicating that the speed N is low and the injection period $T_p$ is short as they are in the closed throttle condition, the ON-signal from the idle switch 16a is regarded as correct. Then, the flag indicating that the signal from the switch is at fault is reset (step 214). If the relation $N_2<N$ is obtained (step 204), the flow goes to step 211, where a decision is made to ascertain whether the relation $N_1 \leqq N$ holds. If the result is YES, a decision is made to see if $T_{p1} \leqq T_p$ (step 212). If this relationship holds indicating that the speed N is high and injection period $T_p$ is long under open throttle condition, the flag indicating that the idle switch is at fault is reset (step 214) in the same manner as the foregoing.

If any one of the results of the decisions made at steps 205 through 212 in the idle switch fault decision routine is NO, then the flag indicating that the idle switch is at fault is not altered.

Figure 5:
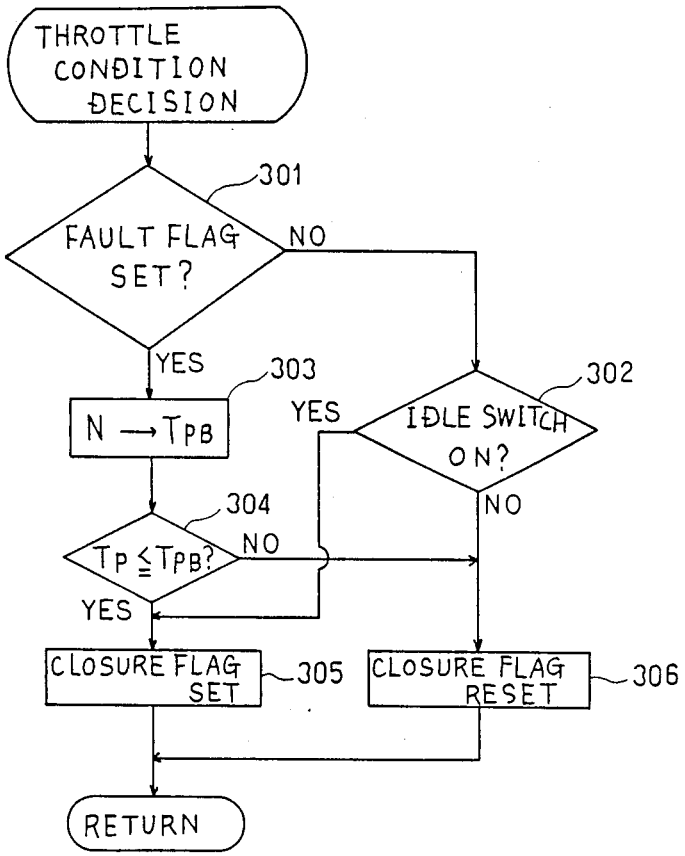
FIG. 5 is a flowchart particularly illustrating the throttle valve condition decision routine shown in FIG. 3.
Figure 6:
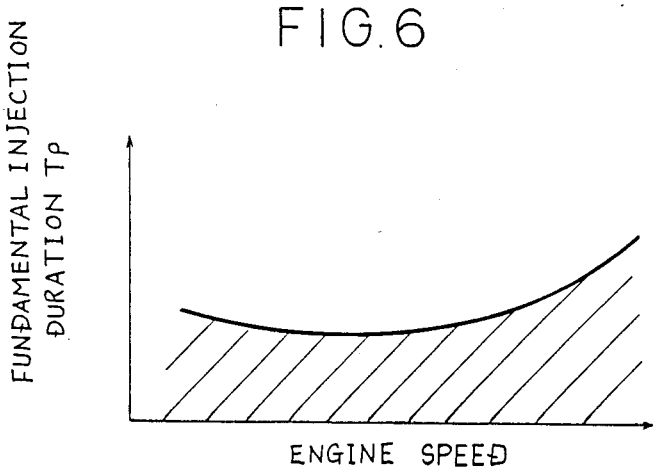
FIG. 6 is a graph showing fundamental injection duration $T_p$ against the engine speed N when the throttle valve is fully closed and no load is applied to the engine.

After completing the fault diagnostic routine at step 103 in FIG. 3, including the above-described idle switch fault decision routine in FIG. 4, the flow proceeds to step 104, where a decision is made to determine whether the throttle valve is open or closed. The processings performed at step 104 are illustrated in FIG. 5. First, a check is made to see if the flag indicating that the idle switch is at fault is set or reset (step 301). If it is reset, i.e., if the idle switch 16a is judged to be normal, then a decision is made to determine whether the switch 16a is closed or open (step 302) in response to the output signal from the switch 16a. If it is closed, then a flag indicating that the throttle valve 2 is fully closed is set (step 305). If it is open, then the flag is reset (step 306). In the event the flag indicating that the idle switch is at fault is set, reference basic or fundamental injection duration $T_{PB}$ is obtained in relation to the engine speed N and is placed in the RAM 42 (step 303). Experiment has shown that the fundamental injection duration $T_p$ expressed with regard to the engine speed N substantially lies within the hatched region in FIG. 6 when the throttle valve is fully closed and no load is applied to the engine. Based on this experiment, the longest possible injection period for each engine speed may be used as the reference $T_{PB}$. The reference fundamental injection durations $T_{PB}$ (FIG. 7) which have previously been set according to the solid line shown in FIG. 6 and stored are read out according to the speed N (step 303). The fundamental injection duration $T_p$ calculated at step 102 in FIG. 3 is read from the RAM 42 and compared with the reference fundamental injection duration $T_{PB}$ to determine whether $T_p \leqq T_{PB}$ (step 304). If this relation holds, the throttle valve 2 is estimated to be fully closed. Then, the flag indicating the full closure is set. If $T_p>T_{PB}$, then the throttle valve 2 is estimated not to be fully closed. The flag indicating the full closure is reset (step 306). Thus, when the idle switch 16a is at fault, opening and closing of the throttle valve 2 is inferred from the length of the basic fuel injection period $T_p$.

In the routine for detecting the closure of opening of the throttle valve, when the flag indicating that the idle switch is at fault is set, the range of the fundamental=a1 injection duration $T_p$ which is used when the throttle valve 2 is fully closed and no load is applied to the engine varies with aging of the engine and changes in the environmental factor. The reference fundamental injection duration $T_{PB}$ used to infer the closure or opening of the throttle valve is based on this varying duration $T_p$. For example, for a time after the manufacture of the engine 9, the region of the fundamental injection duration $T_p$ that is used when the throttle valve 2 is fully closed and no load is applied to the engine decreases because of a reduction in mechanical friction. Inversely, after a lapse of a certain period, the mechanical friction increases, moving the region of the duration $T_p$ upward. At higher altitudes the atmospheric pressure are lower and so the region of the duration $T_p$ is located at lower positions. Accordingly, it is most preferred that the reference fundamental injection duration $T_{PB}$ is modified or updated in a process like learning in a reference load condition learning routine 105.

Figures 7, 8:
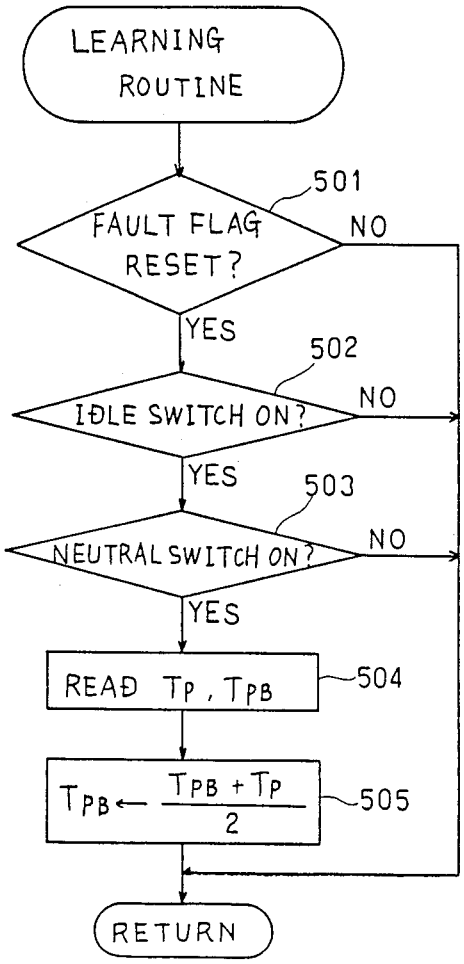
FIG. 7 is a table of values of the reference fundamental injection duration $T_{PB}$ which is used in the throttle valve condition decision routine shown in FIG. 5 and which is set for various values of the engine speed.
FIG. 8 is a flowchart particularly illustrating the standard load learning routine shown in FIG. 3.

The learning routine 105 is particularly shown in FIG. 8. A decision is made to ascertain whether the flag indicating that the idle switch is at fault is reset or not (step 501). Next, if the fault flag is reset, a decision is made to determine whether the idle switch 16a is closed (step 502). Subsequently, if the throttle full closure flag is set, a decision is made to see if the neutral switch 22 is closed (step 503). If the results of the decisions at steps 501 through 503 are all YESes, it is assumed that the throttle valve 2 is fully closed and that no load is applied to the engine. The flow then goes to step 504. If any one of the results of the decisions at steps 501 through 503 is NO, then the present routine is terminated without performing the following steps. At step 504, data of the calculated fundamental injection duration $T_p$ is read from the RAM 42, and data of the reference fundamental injection duration $T_{PB}$ corresponding to the present engine speed is read from the backup RAM 42a. Then, a new reference fundamental injection duration $T_{PB}$ given by $(T_{PB}+T_p)/2$ is calculated and stored in the backup RAM 42a to be used next time (step 505). Thus, the present routine for updating the $T_{PB}$ is ended.

In this way, the reference standard injection duration $T_{PB}$ used in the throttle valve condition decision routine is modified, making use of the fundamental injection duration $T_p$ that is employed when the idle switch 16a is in its normal state, the throttle valve 2 is fully closed, and no load is applied to the engine. Hence, when the idle switch 16a is at fault, full closure of the throttle valve can be inferred with certainty in the throttle valve condition decision routine.

After completing the reference load learning routine of FIG. 8, the flow goes to step 106, where a final fuel injection duration is calculated. In this step 106, a well known compensation is made. Specifically, data on the fundamental injection duration $T_p$ is read from the RAM 42. Then, the duration is compensated for, taking account of the intake air temperature sensed by the intake air temperature sensor 15, the water temperature sensed by the water temperature sensor 18, etc. Further, the difference between the present air-fuel ratio detected by the air-fuel ratio sensor 17 and an intended air-fuel ratio is taken into account. Thus, the final fuel infection duration $T_i$ is stored in the RAM 42. Thus, the present routine is ended.

Step 107 is a fuel cutoff decision routine for determining whether the injection of fuel should be cut off when the engine is decelerating. In step 107, it is determined whether fuel injection should be cut off in view of the engine speed and the throttle position. When the engine speed N is in excess of a certain value $N_3$ and the throttle closure flag is set, the cut off flag is set so that fuel injection is cut off. If the throttle closure flag is reset, or if the speed N is less than the certain value $N_3$, then the cut-off flag is reset so that fuel injection is not cut off, thus ending the present routine.

Step 108 is an idle state decision routine for ascertaining whether a feedback control of the idling speed of the engine should be provided. This feedback control is provided when all the following three conditions are met: (1) The throttle closure flag indicating that the throttle valve is closed is set; (2) The speed N is less than a certain value $N_4$; and (3) The neutral switch 22 is actuated. Then, a flag indicating an idle is set so that feedback control of idling speed is performed in the known manner. If any one of the conditions is not satisfied, the feedback control of the speed N should not be provided. Then, the flag indicating an idle is reset. Thus, the present routine is terminated.

Step 109 is an airflow control valve control quantity calculation routine for calculating the quantity of control over the airflow control valve 6a from the result of the decision made at the idle state decision routine. If the flag indicating an idle is reset, a fixed control quantity for an open-loop control depending on the water temperature or other factors is read from a map stored in the ROM 41. This control quantity $I_0$ is set as the present control quantity I, thus completing the present routine. If the flag indicating an idle is set, a feedback control of the engine speed N is provided as is well known in the art. First, the difference $\Delta N$ between the present speed N and an intended speed $N_0$ that is set, taking account of the water temperature and other factors is found. Then, a modifying value D is obtained, taking account of the sign, positive or negative, and the magnitude of the difference, such that the difference $\Delta N$ decreases down to zero. This modifying value D is added to the open-loop control quantity I obtained during the execution of the previous routine to determine the present control quantity I ($=I+D$), thus completing the present routine.

Step 110 is a nonsynchronous or asynchronous injection decision routine, in which a decision is made to determine whether the flag indicating the throttle full closure is set. If it is set, an ACC flag allowing asynchronous injection is set so that fuel is injected asynchronously upon acceleration from throttle closure state. If the flag indicating the full closure is reset, and if the ACC flag is set, then a flag instructing execution of asynchronous injection is set. At the same time, the ACC flag is reset. Thus, the present routine is ended.

Step 111 is a fuel injection valve actuation routine, in which the fuel injection duration $T_i$ calculated in the fuel injection duration calculation routine and stored in the RAM 42 is delivered to the output circuit 45 at given injection timing (at a predetermined crankshaft position) so that fuel is injected synchronously with engine rotation, provided the flag indicating cutoff of fuel is not set. If this flag is set, the calculated duration is not delivered to the output circuit 45. In the asynchronous injection decision routine, if the flag instructing execution of asynchronous injection is set, then a duration $T_0$ which has been previously determined independently of the aforementioned given fuel injection timing is delivered to the output circuit 45. Concurrently, the flag instructing execution of asynchronous injection is reset. The output circuit 45 delivers a driving signal having the duration $T_i$ or $T_0$ to the fuel injection valve 7.

Step 112 is an airflow control valve actuation routine, in which the present control quantity I obtained in the control quantity calculation routine is delivered to the output circuit 46. The output circuit 46 delivers an actuating signal corresponding to the control quantity I to the airflow control valve 6a.

In the present example, in the event that a fault in the idle switch 16a is detected, it is desired to light a warning lamp for informing the driver of the occurrence of a fault so that the vehicle is driven to the repair shop or turnout.

As described above, even if the idle switch 16a should be at fault, full closure of the throttle valve 2 can be inferred by comparing the calculated fundamental injection duration $T_p$ obtained at that time with the reference fundamental injection duration $T_{PB}$. Therefore, the operation of the internal combustion engine which is effected in response to full closure of the throttle valve 2 is controlled in the same manner as in the case where the idle switch 16a is in normal state. Thus, when the driver drives the vehicle toward a turnout or other safe location while informed of a fault, it is ensured that the engine operates in the same manner as in the case where the switch 16a is in normal state. For example, when the engine is decelerating, the supply of fuel is cut off in normal manner. This prevents emission of unburned exhaust gas and assures protection of the catalyst in the exhaust system and the reactor. Since idle can be sensed, feedback control of the engine speed can be provided certainly. While the vehicle is going to a turnout, the operation of the idling engine is sufficiently assured. When the vehicle is accelerated after the throttle valve 2 is fully closed, asynchronous injection is normally effected. This assures a sufficient accelerating ability when the vehicle is driven toward a turnout. In this way, while the vehicle is going to a turnout, the drivability is not poorer than the case where the throttle switch 16a is in normal state.

The reference fundamental injection duration $T_{PB}$ is modified according to the fundamental injection duration $T_p$ which is used when the idle switch 16a is in normal state, the throttle valve 2 is fully closed, and no load is applied to the engine. Therefore, even if the range of the fundamental injection duration $T_p$ that is used when the throttle valve 2 is fully closed and no load is applied to the engine 9 varies with aging of the engine 9 or changes in the environmental conditions, a compensation is made for these changes. This ensures that full closure of the throttle valve can be inferred when the idle switch 16a is at fault.

In the above example, the fundamental injection duration $T_p$ was used to express the load applied to the engine 9. It should be noted, however, that one expressing the load applied to the engine 9 is not limited to the duration $T_p$. For example, the amount of admitted air Q, the pressure inside the intake tube, or the degree of opening of the throttle valve 2 may also be used.

Also in the above example, the neutral condition of the transmission was detected to sense the unloaded state. Instead of this, the engagement or disengagement of the clutch may be detected to know the unloaded condition.

What we claim is:

1. An apparatus for controlling an internal combustion engine having a throttle valve comprising:

load detecting means for detecting a load of said engine;

throttle position detecting means for detecting an opening degree of said throttle valve;

fault detecting means for detecting when there is a fault in the operation of said throttle position detecting means;

engine parameter detecting means for detecting engine operational parameters;

storage means having data stored therein relating a plurality of reference engine loads to engine operational parameters;

simulating means, responsive to said engine parameter detecting means, for determining based on data stored in said storage means a reference load corresponding to detected engine parameters, comparing that reference load with the load detected by said load detection means, and simulating throttle position status when said fault detecting means detects a fault in the operation of said throttle position detecting means;

updating means for updating the reference load data stored in said storage means when said fault detecting means detects no fault in the operation of said throttle position detecting means; and control means for (1) controlling the operation of the engine according to the position of said throttle valve as detected by said throttle position detecting means when said fault detecting means determines that there is not a fault in the operation of said throttle position detecting means and (2) controlling the operation of said engine in accordance with a simulated throttle position produced by said simulating means when said fault detecting means determines that there is a fault in the operation of said throttle position detecting means.

2. An apparatus according to claim 1, wherein said engine parameter detecting means comprises means for detecting a rotational speed of said engine, and wherein said storage means stores a plurality reference loads corresponding to various rotational speeds, the simulating means selecting a reference load from said storage means that corresponds to a detected rotational speed.

3. An apparatus according to claim 2, wherein said updating means updates the reference loads stored in said storage means based on rotational speeds detected by said rotational speed detecting means.

4. An apparatus according to claim 1, wherein said fault detecting means comprises:

first means for comparing, when the throttle position detecting means detects a closed throttle valve, at least one of a detected rotational speed and a detected load with a first predetermined value;

second means for comparing, when the throttle position detecting means detects an open throttle valve, at least one of a detected rotational speed and a detected load with a second predetermined value smaller than said first predetermined value; and third means for determining a fault in the operation of said throttle position detecting means in response to at least one of said first comparing means and said second comparing means.

5. An apparatus according to claim 1 further comprising:

speed detecting means for detecting rotational speed of said engine, and wherein said control means controls the rotational speed so as make the rotational speed tend to a desired rotational speed.

6. An apparatus according to claim 1 further comprising:

speed detecting means for detecting rotational speed of said engine, and wherein said control means controls a fuel supply of said engine so that the fuel supply is cut off when the rotational speed exceeds a desired rotational speed.

7. An apparatus for controlling an internal combustion engine having a throttle valve comprising:

load detecting means for detecting a load of said engine;

speed detecting means for detecting a rotational speed of said engine;

throttle position detecting means for detecting an opening degree of said throttle valve;

control means for controlling the operation of the engine according to the load detected by said load detecting means, the rotational speed detected by said speed detecting means, and the throttle position detected by said throttle position detecting means;

first comparing means for comparing, when said throttle position detecting means detects that said throttle valve is closed, the load detected by said load detecting means with a predetermined reference load;

second comparing means for comparing, when said throttle position detecting means determines that said throttle valve is closed, the rotational speed detected by said speed detecting means with a predetermined reference rotational speed; and fault detecting means for detecting that there is a fault in the operation of said throttle position detecting means when the actual load exceeds said predetermined reference load as determined by said first comparing means and the rotational speed exceeds said predetermined reference rotational speed as determined by said second comparing means.

8. An apparatus for controlling an internal combustion engine having a throttle valve comprising:

load detecting means for detecting a load of said engine;

speed detecting means for detecting rotational speed of said engine;

throttle position detecting means for detecting an opening degree of said throttle valve;

control means for controlling the operation of the engine according to the load detected by said load detecting means, the rotational speed detected by said speed detecting means, and the throttle position detected by said throttle position detecting means;

first comparing means for comparing, when said throttle position detecting means detects an open throttle valve, the load detected by said load detecting means with a predetermined reference load;

second comparing means for comparing, when said throttle position detecting means detects an open throttle valve, the rotational speed detected by said speed detecting means with a predetermined reference speed; and fault detecting means for detecting that there is a fault in the operation of said throttle position detecting means when the actual load exceeds said predetermined reference load as determined by said first comparing means and the rotational speed exceeds said predetermined reference rotational speed as determined by said second comparing means.

9. An apparatus for controlling an internal combustion engine having a throttle valve comprising:

intake condition detecting means for detecting an intake condition of said engine;

speed detecting means for detecting a rotational speed of said engine;

throttle position detecting means, installed in said throttle valve, for detecting an opening degree of said throttle valve;

fuel injection means for injecting fuel into said engine; and programmed computer means for determining amount of fuel to be injected by said fuel injection means in accordance with outputs of said intake condition detecting means, said speed detecting means and said throttle position detecting means, said computer means including storage means storing therein a reference value indicative of a basic amount of fuel which is usually injected when the throttle valve is fully closed, and said computer means being programmed to perform the steps of, (a) calculating a basic amount of fuel in accordance with detected rotational speed and the detected intake condition, (b) discriminating whether the throttle position detecting means is operating faulty or not in response to the output of said throttle discriminating means, output of said speed detecting means, and the calculated basic amount of fuel with the stored reference value thereby to infer opening and closure of said throttle when the calculated amount of fuel is larger and smaller than the reference value, respectively, (c) updating the reference value by the calculated basic amount of fuel when said throttle position detecting means detects a closing of said throttle valve and said computer means determines that the throttle position detecting means is operating without fault, and (d) compensating the calculated basic amount of fuel in response to the inferred opening and closure of said throttle valve.

10. An apparatus according to claim 9, wherein said computer means is programmed to perform said step (b) when the output of said throttle position detecting means indicates closing of said throttle valve by:

(b1) comparing the detected rotational speed with a first speed value, (b2) comparing the calculated basic amount of fuel with a first fuel amount value, (b3) determining that said throttle position detecting means is operating faulty when both the detected rotational speed and the calculated basic amount of fuel are larger than the first speed value and the first fuel amount value, respectively.

11. An apparatus according to claim 10, wherein said computer means is programmed to perform said step (b) when the output of said throttle position detecting means indicates opening of said throttle valve by:

(b4) comparing the detected rotational speed with a second speed value smaller than the first speed value, (b5) comparing the calculated basic amount of fuel with a second fuel amount value smaller than the first fuel amount value; and (b6) determining that said throttle position detecting means is operating faulty when both the detected rotational speed and the calculated basic amount of fuel are smaller than the second speed value and the second fuel amount value, respectively.

12. An apparatus according to claim 9, wherein said computer means stores in said storage means the reference value indicative of basic amount of fuel in relation to each rotational speed of said engine, and wherein said computer means is programmed to perform further step of:

(e) selecting the most appropriate one of the reference value in response to the detected rotational speed.

* * * * *